United States Patent [19]

Norman

[11] 4,381,863

[45] May 3, 1983

[54] FINGER HOLE INSERT FOR BOWLING BALLS

[75] Inventor: Bill Norman, Tustin, Calif.

[73] Assignee: Master Industries, Inc., Irvine, Calif.

[21] Appl. No.: 282,418

[22] Filed: Jul. 13, 1981

[51] Int. Cl.[3] ..... A63B 37/00

[52] U.S. Cl. ..... 273/63 A

[58] Field of Search ..... 273/63 R, 63 A, 63 B, 273/63 C, 63 D, 63 E, 63 F, 63 G

[56] References Cited

U.S. PATENT DOCUMENTS

| | | | |
|---|---|---|---|
| 447,011 | 2/1891 | Harman | 273/63 A |
| 626,584 | 6/1899 | Wilmerling | 273/63 A |
| 712,192 | 10/1902 | Immen | 273/63 R |
| 950,838 | 3/1910 | Cavanagh | 273/63 A |
| 2,273,199 | 2/1942 | Hilton et al. | 273/63 |
| 2,482,190 | 9/1949 | Kramer | 273/63 |
| 2,646,985 | 7/1953 | Nagy et al. | 273/63 |
| 2,708,578 | 5/1955 | Mitchell | 273/63 |
| 2,712,160 | 7/1955 | Sterczek | 18/55.05 |
| 3,078,097 | 2/1963 | Mitchell | 273/63 A |
| 3,271,031 | 9/1966 | Mitchell | 273/63 |
| 3,454,440 | 7/1969 | Vezirakis | 156/242 |
| 3,784,198 | 1/1974 | Bach | 273/63 |
| 3,804,412 | 4/1974 | Chetirko | 273/63 |

FOREIGN PATENT DOCUMENTS

| | | | |
|---|---|---|---|
| 19182 | 12/1928 | Netherlands | 273/63 A |

*Primary Examiner*—George J. Marlo

*Attorney, Agent, or Firm*—Gausewitz, Carr, Rothenberg & Edwards

[57] ABSTRACT

To augment the spin and lift imparted to a bowling ball as it leaves the hand of the bowler, there are mounted in the finger holes inserts having inwardly protuberant ridges at the rims thereof. The tips of the fingers are hooked around these ridges when the ball is gripped, and continue to be at least partially hooked therearound during release of the ball, so that there is sufficient force imparted to the ball during release to create improved spin and lift. There is provided on the inner ends of the inserts walls having central holes therethrough, for purposes of aiding insertion of the inserts, relieving air pressure, and permitting inspection at any time.

8 Claims, 4 Drawing Figures

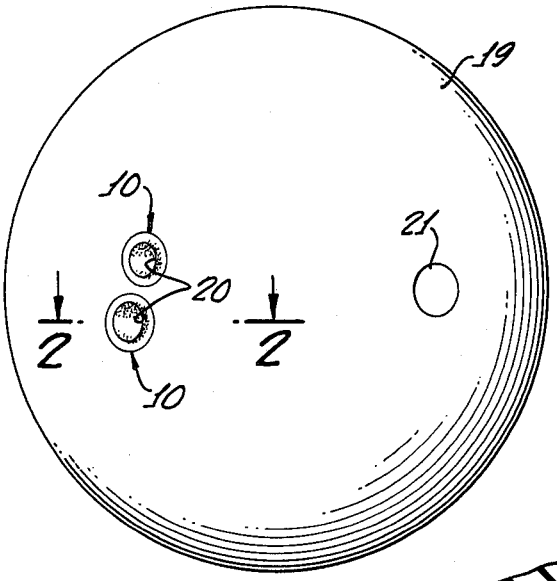
FIG. 1.
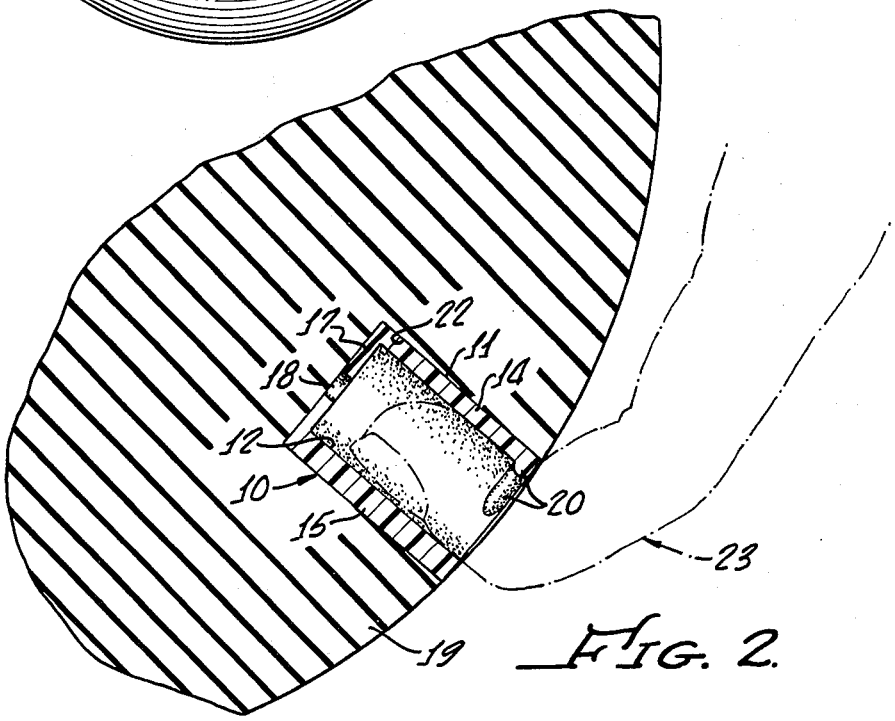
FIG. 2.
FIG. 3.
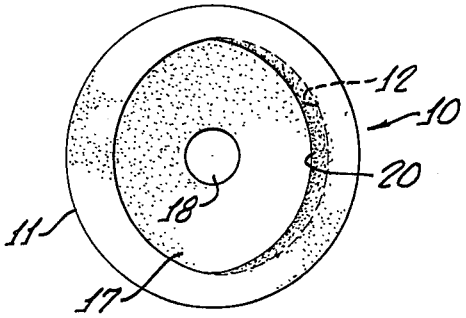
FIG. 4.
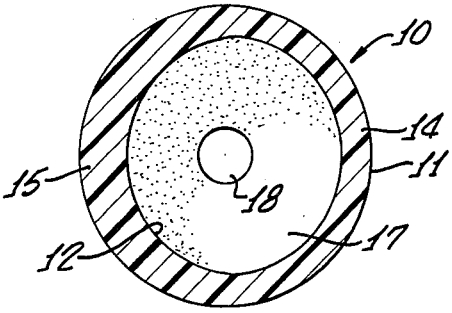

FINGER HOLE INSERT FOR BOWLING BALLS

BACKGROUND OF THE INVENTION

For many decades there have been provided various types of inserts in the finger holes of bowling balls. Some such inserts were hollow cylinders, and others were pads, but the vast majority were intended solely to improve the grip of the bowler or to prevent soreness of the fingers. Many of these inserts were difficult to mount in the finger holes, and did not permit complete inspection of the bowling ball during tournament play.

SUMMARY OF THE INVENTION

Applicant has now discovered that an inwardly protuberant ridge at the rim of each insert, that is to say adjacent the surface of the bowling ball, provides increased spin and lift when the tip of a finger is hooked around the ridge durig both gripping and releasing. The interior insert wall at regions below the ridge is relatively smooth—not ridged—so that the gripping action at these regions is the result of the frictional characteristics of the insert material.

Each insert is adhesively secured in tight-fitting relationship in a drilled hole in the ball, and this often requires application of considerable insertion force. In accordance with one aspect of the present invention, there is a radial wall at the inner end of the insert, and against which either a finger tip or some tool may be pressed in order to push the insert inwardly. Furthermore, this radial wall has an aperture adapted to relieve air pressure in the hole bottom, so that there will be no piston action, and further adapted to permit the bowling ball wall adjacent the hole bottom to be inspected at any time during a tournament.

BRIEF DESCRIPTION OF THE DRAWINGS

FIG. 1 is a plan view of a bowling ball incorporating two of the present finger inserts, and also incorporating a hole for the thumb;

FIG. 2 is a greatly enlarged sectional view on line 2—2 of FIG. 1, and illustrating how the end of a finger of the bowler is hooked around the ridge at the insert rim;

FIG. 3 is a plan view of one of the inserts; and,

FIG. 4 is a transverse sectional view thereof.

DETAILED DESCRIPTION OF THE PREFERRED EMBODIMENT

Referring first to FIGS. 2–4, each insert 10 is a hollow cylinder preferably formed of thermoplastic rubber (a deformable rubber-like material) having relatively high surface friction. The exterior surface 11 of the insert is cylindrical, and interior surface 12 thereof is also substantially cylindrical but is not, preferably, coaxial with surface 11. Instead, interior surface 12 is offset somewhat so that one region 14 of the insert wall is relatively thin whereas the opposite region 15 thereof is relatively thick. Preferably, the insert is not long, but is of sufficient length to receive that region of the finger which extends between the extreme finger tip and the first joint.

An end wall 17 is formed integrally at the bottom of the insert. Such wall has a hole 18 therethrough, the size of the hole being sufficient to permit visual inspection of the bowling ball region beneath the insert, but insufficient to permit a finger tip (or insertion tool) to pass through the hole.

At one side of the rim of the insert, and protruding radially inwardly, is a ridge, flange, or lip 20. This ridge is rounded in vertical section, and is small in vertical section. Preferably, it has a radius of about 0.06 inch. As viewed from above (FIG. 3) the ridge is crescent shaped, so that the ridge surface progressively approaches the inner wall surface 12 in directions away from the center of the ridge. The ridge and wall surfaces merge at approximately diametrically opposite portions of the insert. It is pointed out that the relatively thin-walled region 14 of the insert is beneath ridge 20, the ridge therefore being opposite the thick-walled region 15.

Numerous sizes of inserts are provided, so that each bowler may select one having an internal diameter not much larger than that of the finger to be inserted therein. Preferably, there are sizes graded in thirty-seconds of an inch, for example from 19/32 to 29/32 of an inch.

The bowling ball is shown at 19, and has at least two, and preferably three, holes drilled therein. One hole, numbered 21 in FIG. 1, is for the thumb. The remaining holes are for the finger tips and are numbered 22 (FIG. 2). Finger holes 22 are spaced sufficiently far from thumb hole 21 that the fingers flex or bend sharply, at the first joint, during gripping and release of bowling ball 19. Such bending or flexing is toward thumb hole 21.

The exterior surfaces 11 of the inserts are close fits relative to the walls of finger holes 22. The inserts are adhesively secured in the finger holes by a suitable adhesive, which is applied just prior to forcing the inserts into the holes. Such forcing is effected by the extreme tips of the fingers, or by an insertion tool, both of which act upon the bottom wall 17 so that it is not necessary to apply any pressure (which could distort) to the rim portions of the inserts. There is no air pressure build-up in the bottoms of the finger holes during insertion since air therein escapes through holes 18 and thence upwardly around the fingers or insertion tools.

The upper region of the insert rim is caused to be flush with the surface of the bowling ball, as shown in FIG. 2. Ridge 20 is thus closely adjacent but inward of such bowling ball surface. Each insert is turned, during insertion or prior thereto, so that ridges 20 are disposed on the hole sides toward (relatively adjacent) thumb hole 21, as shown in FIG. 1.

During bowling, two finger tips of the bowling hand flex or hook around ridge 20, as shown in FIG. 2 relative to illustrated finger 23. Thus, the inner region of the first joint of each finger is engaged with a ridge 20, while such joint is bent sharply. The finger region between the first and second joints is then outside the ball, not in any part of the hole. At regions below the ridges 20, the finger surfaces engage relatively smooth inner wall portions of the inserts, there being preferably no ridges provided below ridges 20. Ridges 20 and the surface regions therebeneath, all of which have relatively high friction due to the characteristics of the rubber, provide a good grip for the bowler. That, however, is not the primary reason for the inserts.

What is crucially important is that the ridges 20 augment substantially the lift and spin imparted to ball 19 by the bowler during release. Because the finger tips are hooked or flexed around the ridges 20, and because such ridges are at the surface of the balls, there is an effective and relatively long-continued engagement between the finger tips and ridges 20 during release. Stated more specifically, it has been discovered that when ridges 20 are at the lips of inserts 10, and the finger tips are hooked sharply therearound, the effectiveness and duration of the engagement, during the all-important period of release, are distinctly enhanced in comparison to what would be the case if the ridges were not at the rims. Therefore, lift and spin are improved distinctly.

Thus, in a simple, yet economical and highly effective manner, applicant has provided a device which achieves a substantial number of beneficial results, primarily the enhancing of lift and spin as is greatly desired by bowlers.

The foregoing detailed description is to be clearly understood as given by way of illustration and example only, the spirit and scope of this invention beig limited solely by the appended claims.

I claim:

1. A finger hole insert for bowling balls, which comprises:

(a) a hollow cylindrical body of deformable rubber-like material having an open outer end and a wall at the inner end thereof, said wall having an opening therein sufficiently large to permit inspection of the region of the ball beneath the insert, but sufficiently small to prevent passage therethrough of a finger of the bowler, and (b) an integral inwardly protuberant ridge provided at the rim of the outer end of said insert and adapted to have a finger of the bowler hooked therearound when the ball is gripped, said ridge extending around approximately half the circumference of the body, and being generally crescent shaped so that the ends thereof merge toward the interior surface of said body.

2. The invention as claimed in claim 1, in which said ridge is relatively small in cross-sectional size, having a radius on the order of 0.06 inch, and wherein the region of said body beneath said ridge is free of substantial ridges or corrugations.

3. A bowling ball incorporating inserts in the finger holes thereof, which comprises:

(a) a bowling ball having a thumb hole therein, said bowling ball also having two cylindrical finger holes spaced sufficiently far from said thumb hole that the bowler when gripping the ball will insert only the tips of his gripping fingers in said finger holes, the finger regions between the first and second joints of the gripping fingers being outside the holes and bent toward said thumb hole when the ball is gripped, (b) inserts of deformable rubber-like material provided in said finger holes and sized to receive in relatively close-fitting relationship the regions of the fingers between the extreme finger tips and the first joints, said inserts having exterior surfaces substantially complementary to the surfaces of said finger holes, said inserts having inner cylindrical surfaces, and inwardly-protuberant ridges disposed along said inner cylindrical surfaces thereof at the rims of said inserts relatively adjacent said thumb hole and adapted to have said fingers hooked therearound both during griping of the ball and during release thereof, said ridges being relatively small and convexly rounded in cross section, and extending for approximatly one-half of the circumference of said inner cylindrical surface, whereby the finger tips remain, during release, in effective frictional engagement with said ridges to augment the lift and spin imparted to the ball, said inserts having inner end walls having openings therethrough for permitting inspection of the inner ends of said finger holes in said bowling ball.

4. The invention as claimed in claim 1 in which the regions of said inserts inwardly of said ridges are devoid of ridges or corrugations.

5. The invention as claimed in claim 1, in which the cross-sectional sizes of said ridges have radii on the order of 0.06 inch.

6. An insert for the finger hole of a bowling ball comprising a tubular member of deformable rubber-like material, one end of said member being open the opposite end of said member having an integral radial wall extending thereacross, said wall having a relatively small opening therethrough, said member having a substantially cylindrical inner surface, and a ridge projecting from said cylindrical inner surface at said one end of said member, said ridge extending circumferentially a length such that the ends of said ridge are substantially diametrically opposite each other, said ridge tapering in thickness from the center thereof toward said opposite ends so as to blend into said cylindrical inner surface, said ridge being convexly rounded in cross section.

7. A device as recited in claim 6 in which said member has a substantially cylindrical outer surface and said outer and inner surfaces are eccentric so as to provide said member with a relatively thick cylindrical wall on one side thereof and a relatively thin cylindrical wall on the opposite side thereof, said ridge projecting from said relatively thin cylindrical wall.

8. A device as recited in claim 7 in which said opening is at the center of said radial wall and of sufficient size to permit inspection of the inner end of an opening in a bowling ball receiving said insert.

* * * * *